US005954264A

United States Patent [19]

Keller

[11] Patent Number: 5,954,264

[45] Date of Patent: Sep. 21, 1999

[54] RURAL MAILBOX WITH REMOTE DOOR OPENER

[76] Inventor: Louis D. Keller, 3638 E. McMillan Rd., Twin Lake, Mich. 49457

[21] Appl. No.: 08/993,259

[22] Filed: Dec. 18, 1997

Related U.S. Application Data

[63] Continuation-in-part of application No. 08/907,758, Aug. 8, 1997, abandoned.

[60] Provisional application No. 60/022,465, Aug. 9, 1996.

[51] Int. Cl.[6] ..... B65D 91/00

[52] U.S. Cl. ..... 232/17; 232/45; 49/340

[58] Field of Search ..... 49/14, 137, 199, 49/200, 326, 31, 340, 357; 340/569; 232/17, 34, 35, 45

[56] References Cited

U.S. PATENT DOCUMENTS

| | | | |
|---|---|---|---|
| 1,927,736 | 9/1933 | Davis et al. | 232/35 |
| 2,098,424 | 11/1937 | Holmes | 232/35 |
| 2,465,935 | 3/1949 | Scalia . | |
| 3,144,986 | 8/1964 | Hendrickson | 232/35 |
| 3,163,356 | 12/1964 | Joehnk | 232/35 |
| 3,650,464 | 3/1972 | Lewis . | |
| 3,733,026 | 5/1973 | Rowe et al. . | |
| 3,935,994 | 2/1976 | Darvishian . | |
| 4,154,393 | 5/1979 | Darvishian . | |
| 4,223,828 | 9/1980 | Whitley et al. . | |
| 4,403,760 | 9/1983 | Alvermann . | |
| 4,416,085 | 11/1983 | Lybecker et al. | 49/340 |
| 4,429,491 | 2/1984 | Bruns | 49/340 |
| 4,638,597 | 1/1987 | Lybecker | 49/340 |
| 4,703,635 | 11/1987 | Wyatt . | |
| 4,735,018 | 4/1988 | Duncan et al. | 49/340 |
| 4,782,628 | 11/1988 | Gaddis | 49/340 |
| 4,850,094 | 7/1989 | Lybecker | 49/340 X |
| 4,883,223 | 11/1989 | Taniguchi . | |
| 4,972,629 | 11/1990 | Merendino et al. . | |
| 5,040,331 | 8/1991 | Merendino et al. . | |
| 5,155,470 | 10/1992 | Tuttle . | |
| 5,239,305 | 8/1993 | Murphy et al. . | |
| 5,247,282 | 9/1993 | Marshall | 232/35 X |
| 5,377,906 | 1/1995 | Mason . | |
| 5,427,311 | 6/1995 | Kachmar . | |
| 5,695,113 | 12/1997 | Rau et al. | 232/34 |

*Primary Examiner*—Terry Lee Melius
*Assistant Examiner*—William L. Miller
*Attorney, Agent, or Firm*—Rader, Fishman, Grauer & McGarry

[57] ABSTRACT

A mailbox has a housing with an internal chamber for receiving mail and a mailbox door attached for movement with respect to the housing between a closed position for enclosing the internal chamber and an open position for exposing the internal chamber. A door actuating mechanism is attached to the mailbox and is operable to assist in remotely opening and closing the door by a mail carrier. The door actuating mechanism includes a transmitter; a door mounting section connected to the door; an electrical actuator having an actuator body fixed with respect to the mailbox housing; and an actuator shaft mounted for movement with respect to the actuator body. The shaft has a proximal end portion movably mounted in the actuator body and a distal end portion connected to the door mounting section for opening and closing the door upon movement of the shaft. A receiver is electrically coupled to the actuator for causing the actuator to open or close the mailbox door upon receipt of a signal from the transmitter. A signal flag is pivotally attached to the mailbox housing at a pivot joint and includes a lower portion that extends below the pivot joint when the flag is in a raised position. A flag lowering mechanism has a first end connected to the door for movement therewith and a second end for engagement with the lower portion of the flag. With this arrangement, movement of the door from the closed position to the open position causes the second end to engage and push against the lower end of the flag to thereby pivot the flag to a lowered position. A hollow base supports the mailbox and houses the receiver and actuator body. A battery pack is located within the hollow base for providing electrical power to the receiver and actuator body. The battery pack can be recharged by a solar panel mounted at an upper end of the base. A signal light can be provided on the mailbox to supplement or replace the signal flag.

15 Claims, 4 Drawing Sheets

RURAL MAILBOX WITH REMOTE DOOR OPENER

RELATED APPLICATION

This application is a continuation-in-part of Abn. U.S. patent application Ser. No. 08/907,758 filed on Aug. 8, 1997, which claims the benefit of U.S. Provisional Application No. 60/022,465 filed on Aug. 9, 1996.

BACKGROUND OF THE INVENTION

1. Field of the Invention

This invention relates to rural mailboxes, and more particularly to a mailbox operable by a mail carrier through remote control to open and close the mailbox door and lower a signal flag.

2. Description of the Related Art

The manual opening and closing of a mailbox door and lowering of a mailbox flag by a mail carrier is a time-consuming task. The problem is greatly augmented when repeated many times along the course of a mail route. In recognition of this problem, U.S. Pat. No. 3,733,026 to Rowe et al. and U.S. Pat. No. 4,223,828 to Witley et al. have attempted to provide a system for opening and closing the door of a roadside mailbox by the passing of a mail service vehicle. The mailbox includes a door having an outwardly projecting arm engageable by a slanted actuating rod mounted on the vehicle. As the vehicle approaches the mailbox, engagement of the actuating rod with the arm opens the mailbox door. As the vehicle leaves the mailbox, the rod becomes disengaged from the arm and the door is closed by a return spring. A signal flag on the mailbox, if raised, is automatically lowered by opening the door through a mechanical connection between the flag and door. This system requires precise alignment between the vehicle and mailbox. Many times, mailboxes are installed by residents at varying heights, which makes it difficult to provide any interengageable mechanical system between the vehicle and mailbox.

SUMMARY OF THE INVENTION

A remote door actuating mechanism according to the invention is adapted for use with a mailbox having a housing with an internal chamber for receiving mail and a mailbox door attached for movement with respect to the housing between a closed position for enclosing the internal chamber and an open position for exposing the internal chamber. The actuating mechanism is operable to assist in manual opening and closing of the door, preferably by a mail carrier.

According to one embodiment, the door actuating mechanism comprises a transmitter, a door mounting section, an electrical actuator, and a receiver. The actuator includes an actuator body adapted to be fixed with respect to the mailbox housing and an actuator shaft mounted for movement with respect to the actuator body. The shaft has a proximal end portion movably mounted in the actuator body and a distal end portion connected to the door mounting section for opening and closing the door upon movement of the shaft. The receiver is electrically coupled to the actuator for causing the actuator to open or close the mailbox door upon receipt of a signal from the transmitter. Preferably, the electrical actuator is a linear actuator and reciprocal movement of the actuator shaft with respect to the actuator body causes the opening and closing of the door.

According to the invention, the door mounting section includes a lever arm that is adapted for mounting to the door such that a lower portion of the lever arm extends below a bottom of the door. The distal end portion of the actuator shaft is pivotally connected to the lower portion of the lever arm. The lower portion of the lever arm preferably curves outwardly away from the door when mounted thereto. With this arrangement, relatively small reciprocal movement of the actuator shaft with respect to the actuator body causes the door to reciprocate between fully open and fully closed positions.

According to a further embodiment of the invention, a mailbox system has a mailbox comprising a housing with an internal chamber for receiving mail and a mailbox door attached for movement with respect to the housing between a closed position for enclosing the internal chamber and an open position for exposing the internal chamber; and a door actuating mechanism attached to the mailbox. The actuating mechanism is operable to assist in opening and closing the door by a mail carrier and includes a transmitter, a door mounting section connected to the door, an electrical actuator, and a receiver. The actuator has an actuator body fixed with respect to the mailbox housing and an actuator shaft mounted for movement with respect to the actuator body. The shaft has a proximal end portion movably mounted in the actuator body and a distal end portion connected to the door mounting section for opening and closing the door upon movement of the shaft. The receiver is electrically coupled to the actuator for causing the actuator to open or close the mailbox door upon receipt of a signal from the transmitter.

Further, according to the invention, the mailbox system comprises a hollow base connected to the mailbox for supporting the mailbox in an upright position above ground level with at least a portion of the actuator being mounted in the hollow base. A battery pack comprising at least one battery is preferably located within the hollow base with the at least one battery being electrically connected to the transmitter and actuator. In a preferred embodiment, the hollow base includes a first generally horizontal member connected to the mailbox and a second generally vertical member extending from the first member. A solar panel is supported on the second generally vertical member and is electrically connected to the at least one battery for recharging the battery.

According to a further embodiment, a flag lowering mechanism for a mailbox having a flag pivotally attached thereto at a pivot joint and a lower flag portion that e:tends below the pivot joint includes an elongate member having a first end fixedly connected to the door for rotational movement of the elongate member therewith and a second end for engagement with the lower portion of the flag. With this arrangement, rotational movement of the door from the closed position to the open position causes the second end of the flag lowering mechanism to rotate and push against the lower end of the flag to thereby pivot the flag to a lowered position from a raised position.

An important object of the invention is to provide the mail carrier with a hands-free operation of opening and closing the mailbox door and lowering the mailbox flag from a remote location. Thus, the mail carrier can open the mailbox door and lower the flag if raised before arriving at the mailbox, and can subsequently close the mailbox door after departing from the mailbox.

These and other objects, advantages and features of the invention will be apparent from the ensuing description taken in conjunction with the accompanying drawings.

BRIEF DESCRIPTION OF THE DRAWINGS

The invention will now be described with reference to the drawings in which.

DETAILED DESCRIPTION OF THE PREFERRED EMBODIMENTS

Figure 1:
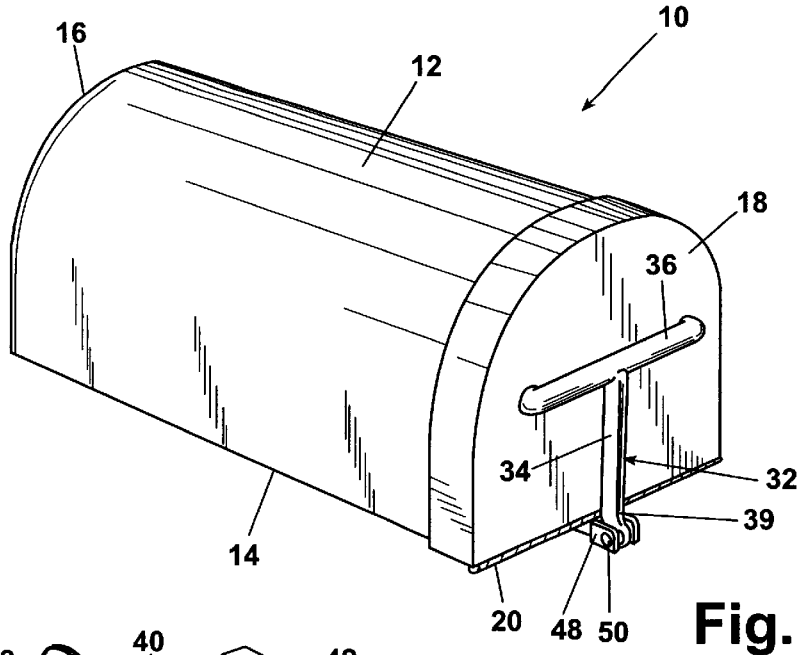
FIG. 1 is perspective view of a rural mailbox showing a portion of a door actuating mechanism according to the invention.
Figure 2:
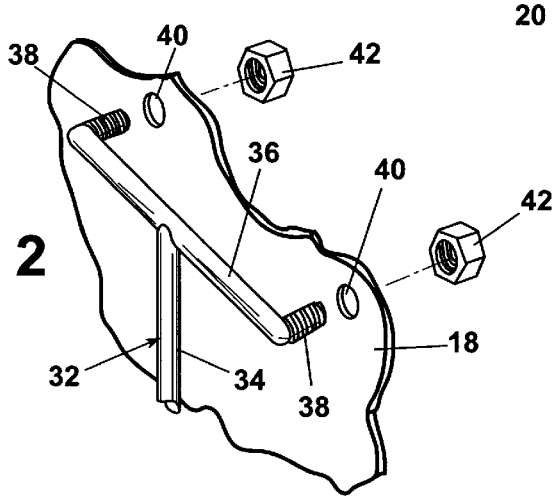
FIG. 2 is an enlarged exploded perspective view of FIG. 1 and illustrating attachment of a portion of the door actuating mechanism to a mailbox.
Figure 3:
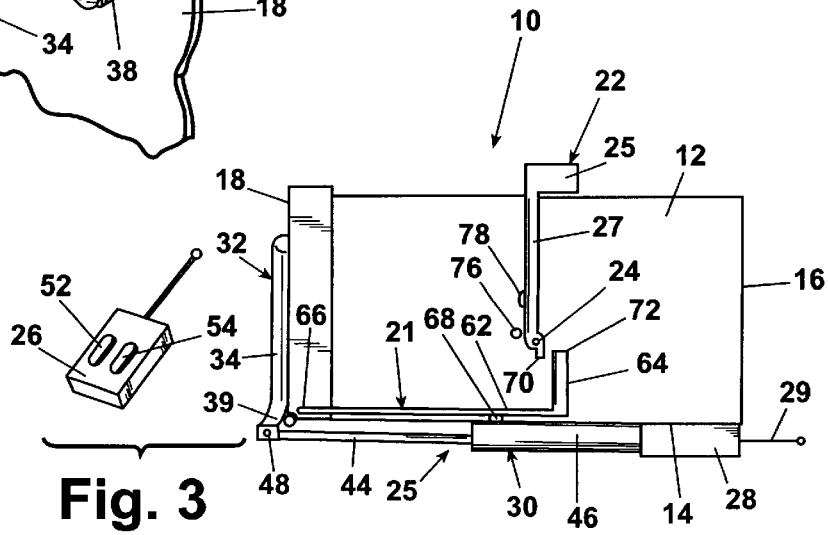
FIG. 3 is a side elevational view of the rural mailbox and door actuating mechanism of FIG. 1 with the door closed and the flag raised.
Figure 4:
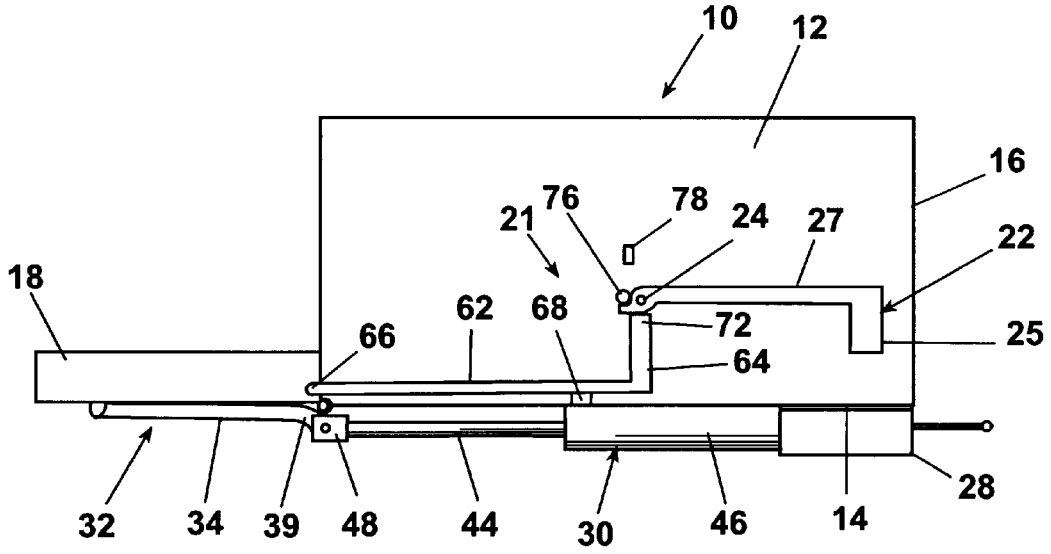
FIG. 4 is a side elevational view similar to FIG. 3 with the door opened and the flag lowered.
Figure 7:
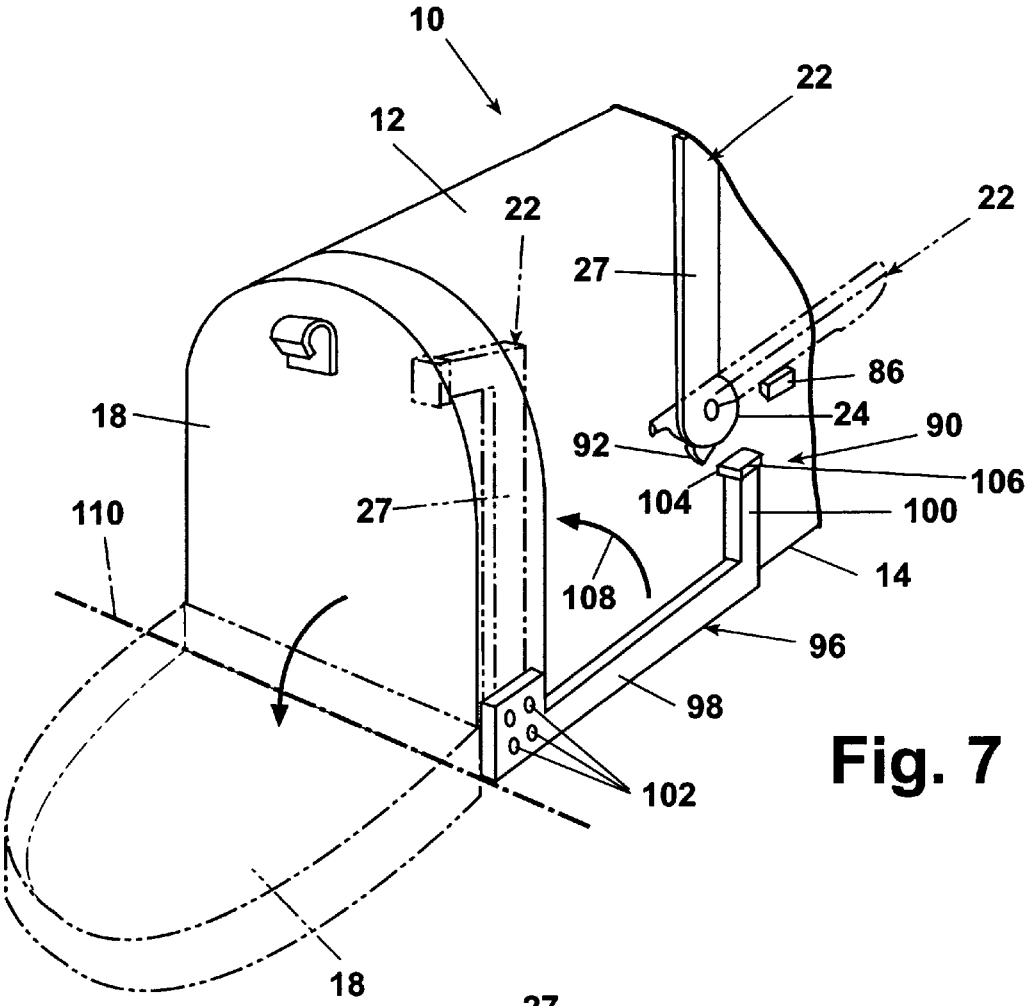
FIG. 7 is a perspective view of a rural mailbox with a flag lowering mechanism according to a third embodiment of the invention attached thereto.

Referring now to FIGS. 1–4, a rural mailbox 10 is of a conventional construction and includes a housing 12 of an inverted U-shaped cross-section, with a floor or bottom 14 and a closed end 16. A door 18 is pivotally attached to the mailbox 10 at an open end thereof through a horizontally extending hinge 20 for opening and closing the door. A signal flag 22 having a flag portion 23 and an elongate leg portion 27 is attached to the housing 12 through a pin 24 extending through both the elongate leg portion 27 and the housing 12 for rotating the flag 22 between a raised position as shown in FIG. 3, and a lowered position as shown in FIG. 4. If desired, the flag portion 23 can be eliminated, leaving the signal flag 22 with only the elongate leg portion 27, as shown in FIG. 7.

A door actuating mechanism 25 according to the invention comprises, a transmitter 26, a receiver 28, an actuator 30 and a T-shaped door mounting section 32. The door mounting section 32 includes a vertical rod or lever arm 34 attached at its upper end to the center of a horizontal rod or mounting arm 36. Each end 38 of the mounting arm 36 is preferably threaded and bent at a 90° angle with respect to a longitudinal axis of a central section of the mounting arm 36. The T-shaped section 32 is mounted to the door 18 by drilling or otherwise forming a pair of spaced apertures 40 (FIG. 2) in the door 18 at a distance equal to the distance between the rod ends 38. The ends 38 are aligned with the apertures 40 and pushed therethrough until the lever arm and mounting arm are in contact with a front surface of the door 18. A nut 42 is then tightened on each threaded end 38 to secure the T-shaped section 32 to the door. In the installed position, a lower end portion 39 of the lever arm 34 extends below the bottom of the housing 12 and is curved outwardly and away from the door 18.

The actuator 30 and receiver 28 can be attached to the bottom 14 of the mailbox housing 12 through conventional fastening techniques. The actuator 30 is preferably of the solenoid-type and includes a body 46 that receives the proximal end of an electrically actuated plunger or shaft 44. A distal end of the plunger 44 terminates in a clevis 48 that is pivotally connected to the curved lower end 39 of the vertical rod 34 through a pin 50. The receiver 28 interfaces with the solenoid 30 in a well-known manner and actuates the solenoid in response to a signal from the transmitter 26. Due to the position of the pivotal connection between the clevis 48 and the lower end 39 with respect to the horizontal hinge 20, only a small amount of plunger movement is required to completely open and close the door 18. Since the solenoid holds the door closed in the plunger's extended position, there is no longer a need for a detent handle on the door and a cooperating leaf spring on the mailbox housing for keeping the door closed.

The transmitter sends signals to the receiver through amplitude or frequency modulation, infra-red, ultrasound, UHF, etc. In a preferred arrangement, the solenoid and transmitter/receiver are similar to solenoids and transmitters/receivers typically associated with well-known remotely actuated power locks installed in many vehicles. The transmitter, receiver and actuator are preferably battery powered, although other well-known power sources can be employed. The strength of the transmitter is arranged such that a signal therefrom will not transmit beyond approximately 50 to 100 feet to avoid the simultaneous opening and/or closing of adjacent mailboxes. Depending on the proximity of adjacent mailboxes along a carrier route, the transmitting distance can be increased or decreased. In addition, two or more, different transmitting channels can be provided in a well known manner to prevent the inadvertent opening and closing of adjacent mailboxes. For this purpose, the transmitter 26 includes a first button 52 for transmitting a signal on a first frequency channel, and a second button 54 for transmitting a signal on a second different frequency channel. Adjacent mailboxes would then be installed with alternating receivers of the first and second frequency channels. Thus, the range from one channel will not inadvertently open or close adjacent mailboxes, since they are on separate channels. Where the distance between mailboxes is large and/or the transmitter signal is relatively weak, a transmitter with a single channel and push-button switch c an be provided.

Likewise, where the distance between mailboxes is small and/or the transmitter signal is relatively strong, a transmitter having more than two channels and corresponding push-button switches can be provided.

In its preferred form, the actuating mechanism 25 is mounted to preexisting rural mailboxes. However, at least a portion of the actuating mechanism can be integrally formed with a mailbox. For example, instead of having a separately attachable door mounting section 32, the door 18 can be reinforced and the lower end 39 of the lever arm 34 can be integrally formed with the door, when the door is constructed of a polymeric material.

In conjunction with opening the mailbox door 18, a mechanism 21 to automatically lower the flag 22 when raised comprises an L-shaped arm 60 having a first horizontal leg 62 and a second vertical leg 64. A proximal end of the first horizontal leg 62 is attached to the proximal end of the second vertical leg 64, while a distal end of the horizontal leg 62 is pivotally attached to the door 18 through a pivot pin 66. A stop 68 is attached to and extends outwardly from a side of the mailbox housing 12 and supports the L-shaped arm 60.

Figure 5:
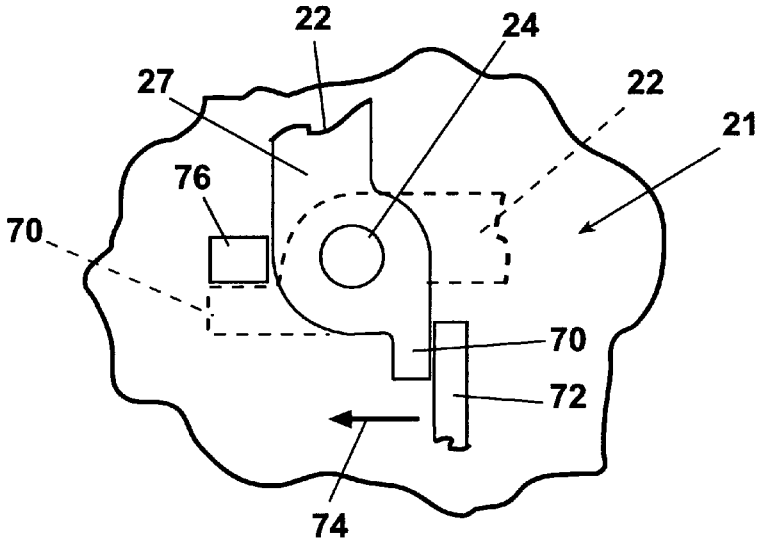
FIG. 5 is an enlarged side view of a flag lowering mechanism according to a first embodiment of the invention.

As seen most clearly in FIG. 5, the lower end of the elongate leg portion 27 of the flag 22 has an offset tab 70 that extends downwardly below the pin 24. A distal end 72 of the second vertical leg 64 is adapted to contact the tab 70. As the door 18 opens, the L-shaped arm 60 moves in a direction as denoted by arrow 74. The distal end 72 of the vertical leg 64 contacts the tab 70 and rotates the flag 22 about its pivot pin 24 in a clockwise direction (as viewed in FIG. 5) to the down position, as represented by dashed line. A stop 76 contacts an opposite side of the tab 70 when the flag is in the down position to prevent further clockwise rotation of the flag. In the down position, the L-shaped arm is free to move to its initial position when the door is closed without interference from the tab 70. The flag can then be raised as needed to the position shown in FIGS. 3 and 5. When the flag 22 is rotated counter-clockwise to a vertical orientation, a stop 78 (FIG. 4) can be provided on the housing 12 to prevent further counter-clockwise rotation.

Figure 6:
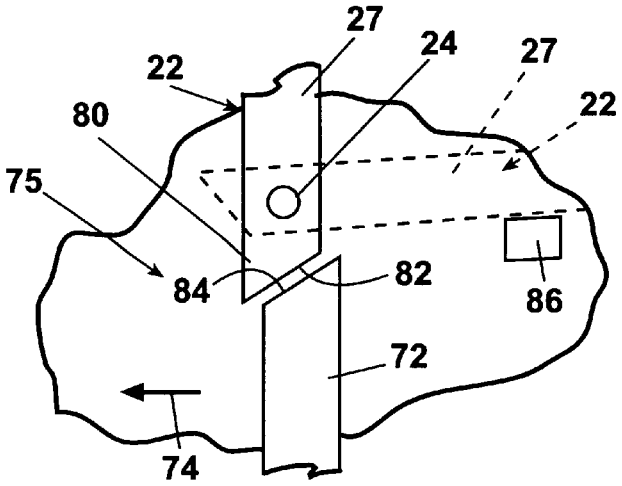
FIG. 6 is an enlarged side view of a flag lowering mechanism according to a second embodiment of the invention.

With reference now to FIG. 6, a flag lowering mechanism 75 according to a second embodiment of the invention will now be described, wherein like parts in the previous embodiment are represented by like numerals. The lower end of the elongate leg portion 27 of the flag 22 has an offset tab 80 that extends downwardly below the pin 24 and includes a surface 82 cut at an acute angle with respect to the longitudinal extent of the elongate leg portion 27. The distal end 72 of the second vertical leg 64 includes a surface 84 having the same angle as the surface 82. As the door 18 opens, the L-shaped arm 60 moves in a direction as denoted by arrow 74. The angled surface 84 of the vertical leg 64 contacts the angled surface of the flag 22 and rotates the flag about its pivot pin 24 in a clockwise direction (as viewed in FIG. 6) from the raised position to the lowered position, as represented by dashed line. A stop 86 can be provided on the housing 12 to prevent further downward rotation of the flag 22.

Figure 8:
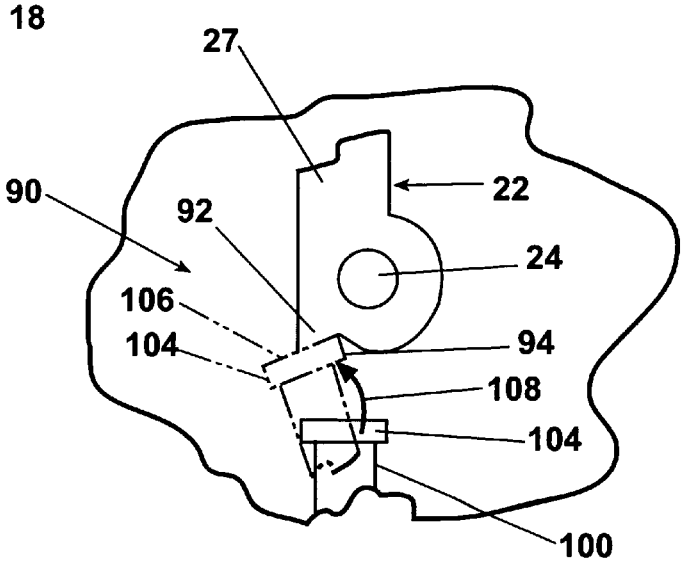
FIG. 8 is an enlarged side view of a portion of the flag lowering mechanism of FIG. 7.

Referring now to FIGS. 7 and 8, a flag lowering mechanism 90 for a mailbox 10 according to a third embodiment is shown, wherein like parts in the previous embodiments are represented by like numerals. As in the previous embodiment, the lower end of the elongate leg portion 27 of the flag 22 has an offset tab 92 that extends downwardly below the pin 24 and includes a surface 94 cut at an acute angle with respect to the longitudinal extent of the elongate leg portion 27. An L-shaped arm 96 has a first leg 98 and a second leg 100 extending preferably substantially perpendicular to the first leg 98. A proximal end of the first leg 98 is attached to the proximal end of the second leg 100, while a distal end of the first leg 98 is fixedly attached to the door 18 through suitable fasteners 102, such as rivets, nuts and bolts, etc. Since the L-shaped arm 96 is fixedly attached to the door 18, the stop 68 in previous embodiments can be eliminated. Preferably, the first leg 98 extends parallel with the floor 14 when the door 18 is completely closed. The distal end of the second vertical leg 100 includes a platform 104 with an upper surface 106 that preferably extends parallel with the first leg 98. As the door 18 opens, the L-shaped arm 96 rotates in a direction as denoted by arrow 108 about a hinge axis 110. As shown in phantom line in FIG. 8, the upper surface 106 of the platform 104 contacts the angled surface 94 of the offset tab 92 and rotates the flag about its pivot pin 24 in a clockwise direction (as viewed in FIGS. 7 and 8) from the raised position to the lowered position, as represented by phantom line. As with the second embodiment, a stop 86 can be provided on the housing 12 to prevent further downward rotation of the flag 22.

Figure 9:
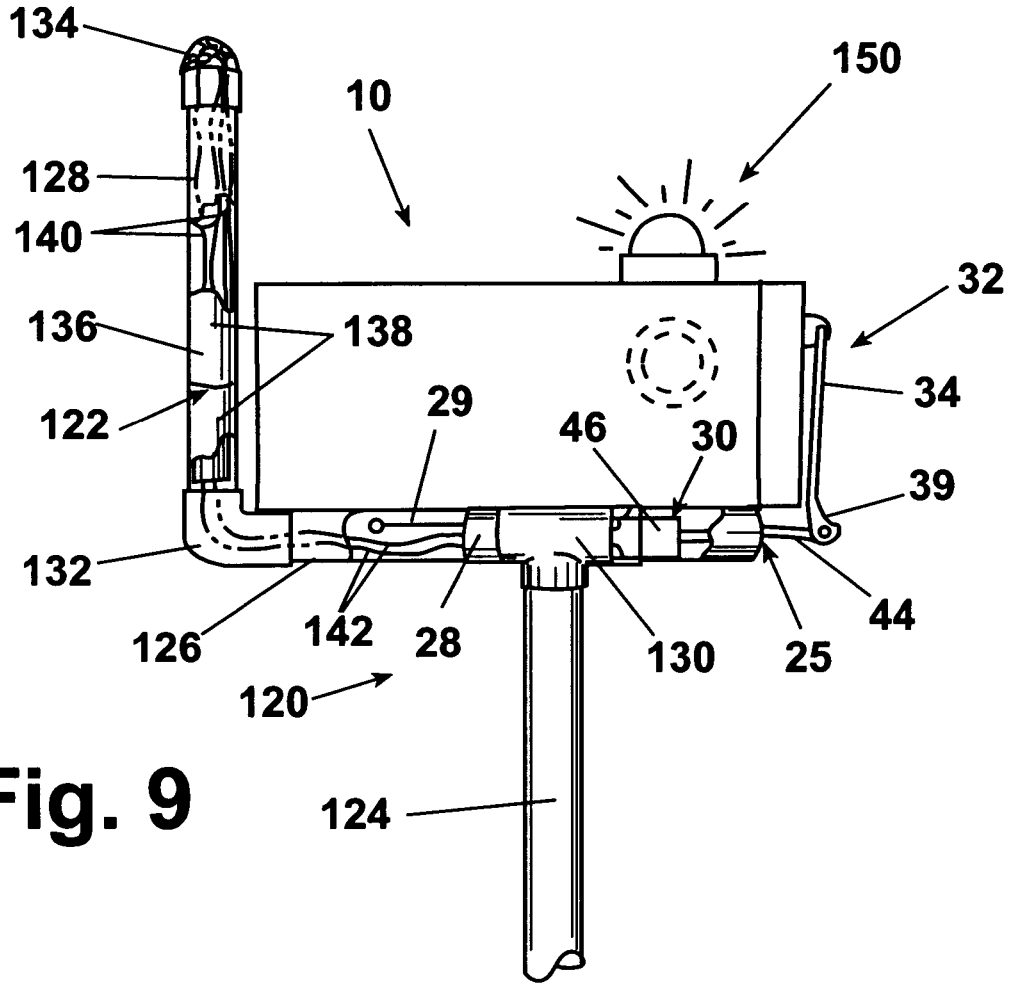
FIG. 9 is a side elevational view of a rural mailbox mounted to a support base and showing an electrical system for supplying electrical power to the receiver and actuator.

Referring now to FIG. 9, a rural mailbox 10 is mounted on a support base 120 that incorporates an electrical supply system 122. The support base 120 comprises a first tubular member 124, a second tubular member 126, and a third tubular member 128 The first tubular member 124 is preferably installed in the ground or other support and extends generally vertically therefrom. The second tubular member 126 is connected to the first tubular member, preferably through a T-connector 130, and extends generally horizontally. The second tubular member 126 mounts the mailbox 10, preferably along a longitudinal centerline of the floor 14. Aligned holes (not shown) in the floor 14 and second tubular member can receive fasteners to secure the mailbox 24 to the support base 120. Alternatively, when the mailbox 10 is formed of a plastics material, the tubular member 126 can be integrally formed with the floor 14 with a collar in place of the T-connector 130 for receiving the first tubular member 124. The third tubular member 128 is connected to the second tubular member 126 through an elbow connector 132, and extends generally vertically. The tubular members 134, 136, and 138 are preferably circular in cross section. However, one or more of the tubular members can have a cross sectional shape that is square, rectangular, triangular, oval, etc.

The electrical supply system 122 comprises a solar panel 134, preferably dome-shaped, that is mounted at an upper end of the third tubular member 128. The solar panel 134 generates voltage upon exposure to light for recharging a battery pack 136 connected to the panel 134 by a first pair of electrical wires 140. The dome shape of the solar panel 134 permits installation of the support base 120 and operation of the door actuating mechanism 25 without regard to the position of the sun at substantially any location on the globe during any season. The battery pack 136 is preferably located within the third tubular member 128 and comprises one or more batteries 138 to provide approximately 12 volts of power to the receiver 28 and actuator 30 through a second pair of electrical wires 142 for opening and closing the door 18 from a remote location. Depending on the particular electrical requirements of the actuator 30 and receiver 28, the battery pack 136 can be constructed to generate more or less voltage. The solar panel in the preferred embodiment serves only to trickle charge the battery pack, and is insufficient by itself to power the actuator. However, it is contemplated that the battery pack can be eliminated, since mail carriers in most locations operate only during daylight hours. In this instance, the solar panel must generate sufficient voltage to operate the receiver and actuator. The receiver 28 and actuator body 46 are preferably mounted in the second tubular member 126 with the actuator shaft 44 extending outwardly of the second tubular member.

Figure 10:
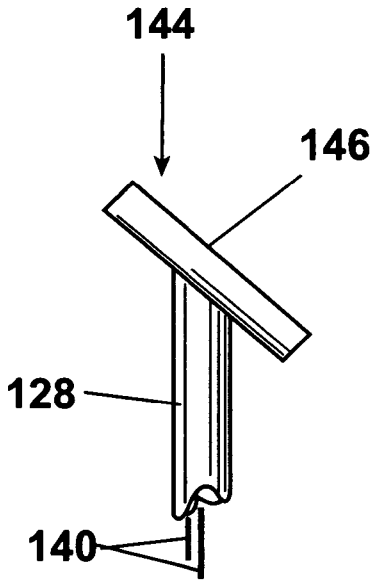
FIG. 10 is a side elevational view of a portion of an electrical supply system according to a second embodiment of the invention.

Although a dome-shaped solar panel 134 is preferred, a conventional flat solar panel 144 can be mounted to the upper end of the third tubular member 128, as shown in FIG. 10. The solar panel 144 is preferably oriented at an acute angle with respect to vertical, and an upper face 146 thereof preferably faces southward upon installation to take full advantage of solar orientation during daylight hours.

With the provision of the solar panel 134, the conventional signal flag 22 can be replaced by a signal light 150 mounted on the mailbox housing 12, as shown in FIG. 9. The signal light 150 is mounted at a location that can clearly be seen by a mail carrier while approaching the mailbox, such as at the top or side (shown in dashed lines) of the housing 12. The signal light 150 is preferably of the flashing type, such as a strobe light, in order to conserve battery power during operation. The signal light can be turned on by a manually operated switch (not shown) when correspondence is left in the mailbox for pick up by a postal carrier.

In use, a mail carrier simply presses the appropriate button on the transmitter 26 as the mail vehicle approaches a mailbox. By the time the vehicle is stopped at the mailbox, the door is in the fully open position, and the flag is in the lowered position, even if previously raised. If a signal light is used, the light can be turned off by a signal to the receiver when the transmitter button is pressed to open or close the door. The mail carrier then completes the transfer of correspondence between the vehicle and mailbox, and closes the door either by pressing the button on the transmitter or by hand. If the transmitter is used to close the door, the mail carrier can press the button as the vehicle is pulling away from the mailbox to save even more time. This process is repeated for the remaining mailboxes along a carrier route. Due to the nature of the solenoid, the occupant can manually open and close the mailbox door to both collect and send correspondence.

In its preferred form, the actuating mechanism 25 is mounted to preexisting rural mailboxes. However, at least a portion of the actuating mechanism can be integrally formed with a mailbox. For example, instead of having a separately attachable door mounting section 32, the door 18 can be reinforced and a lower section 39 can be integrally formed with the door, when the door is constructed of a polymeric material.

The present invention eliminates the need for a mail carrier to lean out of the vehicle for opening and closing the mailbox door. A mail carrier can access correspondence in the mailbox and deliver correspondence thereto from the driver side of a conventional vehicle through the use of common reaching tools, which results in safer driving and cost savings for special vehicles.

Reasonable variation and modification are possible within the spirit of the foregoing specification and drawings without departing from the scope of the invention.

The embodiments of the invention in which an exclusive property or privilege is claimed are defined as follows:

1. A door actuating mechanism adapted for use with a mailbox having a housing with an internal chamber for receiving mail and a mailbox door attached for movement with respect to the housing between a closed position for enclosing the internal chamber and an open position for exposing the internal chamber, the actuating mechanism being operable to assist in manual opening and closing of said door by a mail carrier, said door actuating mechanism comprising:

a transmitter;

a door mounting section comprising a lever arm adapted for mounting to the door such that a lower portion of the lever arm extends below a bottom of the door and curves outwardly away from the door when mounted thereto;

a mounting arm rigidly attached to the lever arm for connecting the lever arm to the door, the lever arm and mounting arm of the door mounting section are generally connected together in a T-shape with the mounting arm including an intermediate portion connected to the lever arm and opposite end portions that extend generally perpendicular to the intermediate portion, each of the opposite end portions being adapted to project through a corresponding aperture in the door for securing the door mounting section thereto, each of the end portions is threaded, and further comprising a pair of internally threaded nuts for attachment to the threaded end portions such that the door is sandwiched between the intermediate portion and the nuts when the door mounting section is mounted to the door;

an electrical actuator having an actuator body adapted to be fixed with respect to the mailbox housing, and an actuator shaft mounted for movement with respect to said actuator body, the shaft having a proximal end portion movably mounted in the actuator body and a distal end portion pivotally connected to the lower portion of the lever arm for opening and closing said door upon movement of said shaft, the electrical actuator is a linear actuator and reciprocal provides movement of the actuator shaft with respect to the actuator body for opening and closing of said door, whereby relatively small reciprocal movement of the actuator shaft with respect to the actuator body is adapted to reciprocate the door between fully opened and fully closed positions; and a receiver electrically coupled to said actuator for causing said actuator to open or close said mailbox door upon receipt of a signal from said transmitter.

2. A door actuating mechanism according to claim 1 and further comprising a flag lowering mechanism having a first end adapted for connection to the door for movement therewith and a second end for engagement with a flag pivotally attached to the mailbox housing; wherein movement of the door from the closed position to the open position is adapted to move the flag from a raised position to a lowered position.

3. A door actuating mechanism according to claim 2 wherein the flag lowering mechanism is generally L-shaped with a generally horizontal leg adapted for connection to the door at said first end and a generally vertical leg that extends from the generally horizontal leg, an upper portion of the generally vertical leg comprising the second end of the flag lowering mechanism; wherein movement of the door from the closed position to the open position is adapted to move the second end to engage and push against the lower end of the flag to thereby move the flag to the lowered position.

4. In a mailbox system having a mailbox comprising a housing with an internal chamber for receiving mail and a mailbox door attached for movement with respect to the housing between a closed position for enclosing the internal chamber and an open position for exposing the internal chamber; and a door actuating mechanism attached to the mailbox, the actuating mechanism being operable to assist in opening and closing the door by a mail carrier, the improvement comprising:

said door actuating mechanism comprising:

a transmitter;

a door mounting section connected to the door;

an electrical actuator having an actuator body fixed with respect to the mailbox housing, and an actuator shaft mounted for movement with respect to said actuator body, the shaft having a proximal end portion movably mounted in the actuator body and a distal end portion connected to said door mounting section, for opening and closing said door upon movement of said shaft; and a receiver electrically coupled to said actuator for causing said actuator to open or close said mailbox door upon receipt of a signal from said transmitter.

5. A mailbox system according to claim 4 and further comprising:

a hollow base connected to said mailbox for supporting said mailbox in an upright position with at least a portion of the actuator being mounted in the hollow base; and at least one battery located within said hollow base; said at least one battery being electrically connected to said transmitter and said actuator.

6. A mailbox system according to claim 5 wherein said hollow base includes a first generally horizontal member connected to said mailbox and a second generally vertical member extending from the first member; and further comprising a solar panel supported on the second generally vertical member, the solar panel being electrically connected to the at least one battery for recharging the battery.

7. A mailbox system according to claim 6 wherein the solar panel is dome-shaped.

8. A mailbox system according to claim 4 wherein the electrical actuator is a linear actuator and reciprocal movement of the actuator shaft with respect to the actuator body causes the opening and closing of said door.

9. A mailbox system according to claim 8 wherein the door mounting section comprises a lever arm mounted to the door such that a lower portion of the lever arm extends below a bottom of the door, the distal end portion of the actuator shaft being pivotally connected to the lower portion of the lever arm.

10. A mailbox system according to claim 9 wherein the lower portion of the lever arm curves outwardly away from the door; whereby relatively small reciprocal movement of the actuator shaft with respect to the actuator body causes the door to reciprocate between fully open and fully closed positions.

11. A mailbox system according to claim 10 and further comprising a mounting arm rigidly attached to the lever arm for connecting the lever arm to the door.

12. A mailbox system according to claim 11 wherein the lever arm and mounting arm of the door mounting section are generally connected together in a T-shape with the mounting arm including an intermediate portion connected to the lever arm and opposite end portions that extend generally perpendicular to the intermediate portion, each of the opposite end portions projecting through a corresponding aperture in the door for securing the door mounting; section thereto.

13. A mailbox system according to claim 12 wherein each of the end portions is threaded, and further comprising a pair of internally threaded nuts attached to the threaded end portions such that the door is sandwiched between the intermediate portion and the nuts.

14. A mailbox system according to claim 4 and further comprising:

a flag pivotally attached to the mailbox housing at a pivot joint;

a flag lowering mechanism having a first end connected to the door for movement therewith and a second end for engagement with the flag; wherein movement of the door from the closed position to the open position causes movement of the flag from a raised position to a lowered position.

15. A mailbox system according to claim 14 wherein the flag includes a lower portion that extends below the pivot joint when the flag is in the raised position; and further wherein the flag lowering mechanism is generally L-shaped with a generally horizontal leg connected to the door at said first end and a generally vertical leg that extends from the generally horizontal leg, an upper portion of the generally vertical leg comprising the second end of the flag lowering mechanism; wherein movement of the door from the closed position to the open position causes the upper portion of the generally vertical leg to engage and push against the lower portion of the flag to thereby pivot the flag to the lowered position.

* * * * *